US005317327A

United States Patent [19]

Piole

[11] Patent Number: 5,317,327

[45] Date of Patent: May 31, 1994

[54] COMPOSITE ANTENNA FOR RECEIVING SIGNALS TRANSMITTED SIMULTANEOUSLY VIA SATELLITE AND BY TERRESTRIAL STATIONS, IN PARTICULAR FOR RECEIVING DIGITAL AUDIO BROADCASTING RADIO SIGNALS

[75] Inventor: Philippe Piole, Rennes, France

[73] Assignees: France Telecom, Issy-Les-Moulineaux; Telediffusion de France, Montrouge, both of France

[21] Appl. No.: 903,937

[22] Filed: Jun. 26, 1992

[30] Foreign Application Priority Data

Jun. 28, 1991 [FR] France ..... 91 08089

[51] Int. Cl.[5] ..... H01Q 1/36

[52] U.S. Cl. ..... 343/725; 343/790; 343/895

[58] Field of Search ..... 343/790-792, 343/725, 729, 730, 895, 846, 830; H01Q 9/16, 9/18, 1/36

[56] References Cited

U.S. PATENT DOCUMENTS

| | | | |
|---|---|---|---|
| 2,531,476 | 11/1950 | Schriefer | 343/791 |
| 2,781,514 | 2/1957 | Sichak et al. | 343/895 |
| 3,184,747 | 5/1965 | Kach | 343/895 |
| 3,523,251 | 8/1970 | Halstead | 343/895 |
| 4,282,528 | 8/1981 | Aspinwall | 343/792 |
| 4,442,438 | 4/1984 | Siwiak et al. | 343/792 |
| 4,494,122 | 1/1985 | Garay et al. | 343/792 |
| 4,730,195 | 3/1988 | Phillips et al. | 343/792 |

FOREIGN PATENT DOCUMENTS

| | | | |
|---|---|---|---|
| 963162 | 5/1957 | Fed. Rep. of Germany | 343/791 |
| 1056673 | 4/1958 | Fed. Rep. of Germany . | |
| 2357078 | 6/1977 | France . | |

*Primary Examiner*—Michael C. Wimer

*Attorney, Agent, or Firm*—Wegner, Cantor Mueller & Player

[57] ABSTRACT

An antenna comprises a quarter-wavelength skirt antenna adapted to be disposed over an artificial ground and comprising a vertical cylindrical tube closed at the upper end and a coaxial feed inside the tube. The radiation pattern of the skirt antenna is essentially omnidirectional with a low elevation angle. The skirt antenna is combined with a helical antenna disposed vertically above the skirt antenna and coaxially therewith. The surface closing the upper part of the tube of the skirt antenna constitutes a reflective plane for the helical antenna favoring a hybrid radiation mode specific to the latter, partially axial and partially radial, by lowering the receive lobe of the radiation pattern towards an elevation angle suitable for receiving signals transmitted via satellite. A coupling device combines the signals received by each of the two antennas and feeds them to a common coaxial line.

6 Claims, 1 Drawing Sheet

COMPOSITE ANTENNA FOR RECEIVING SIGNALS TRANSMITTED SIMULTANEOUSLY VIA SATELLITE AND BY TERRESTRIAL STATIONS, IN PARTICULAR FOR RECEIVING DIGITAL AUDIO BROADCASTING RADIO SIGNALS

BACKGROUND OF THE INVENTION

1. Field of the Invention

The invention concerns an antenna for receiving signals transmitted simultaneously via satellite and by terrestrial means.

It applies in particular to receiving digital audio broadcasting (DAB) radio signals although it is naturally not limited to this application and may be used to receive other types of signal (digital radio broadcast information other than audio programs, radiotelephony, etc) or even to transmit radio signals, by application of the principle of reciprocity.

The broadcasting of high quality sound nevertheless constitutes a particularly critical application in respect of performance and the quality that the user can justifiably expect, especially when receiving signals on board a moving vehicle in an urban environment, and it will be shown that the various features of an antenna in accordance with the invention make it particularly well suited to such use.

2. Description of the Prior Art

To alleviate the presence of lateral obstacles which mask reception, especially in an urban environment, the same program is broadcast simultaneously via satellite and by a plurality of terrestrial broadcasting stations.

The conditions under which signals transmitted by these two means are received are entirely different, both with regard to the radiation pattern required and with regard to the bandwidth and type of polarization.

In the case of signals transmitted by terrestrial broadcasting stations, the radiation pattern needs to have maximum gain (in the direction of the main lobe) for a low elevation angle, in the order of 5° to 20°, with a wide bandwidth and using vertical polarization whereas in the case of signals transmitted via satellite the elevation angle must be much greater (typically in the order of 60°) and circular polarization must be used. In either case the radiation pattern must be omnidirectional in azimuth.

An object of the present invention is to propose a composite antenna able to receive both types of signal simultaneously despite their very different receiving conditions, which is of simple and compact construction, in particular to enable it to be mounted on the roof of a vehicle, and which offers excellent radio performance.

The starting point for the invention is a so-called "quarter-wave skirt" type antenna, that is to say an antenna adapted to be mounted above an "artificial ground", comprising a vertical cylindrical tube closed at the upper end and a coaxial feed inside the tube, the radiation pattern of this skirt antenna being essentially omnidirectional with a low elevation angle.

An antenna of this kind is described in U.S. Pat. No. 2,531,476, for example. Because of its low elevation angle radiation pattern, an antenna of this kind, which is in any event designed for terrestrial mobile radio communication using vertical polarization, is unable to receive signals from satellites.

SUMMARY OF THE INVENTION

The basic idea of the invention is to associate a skirt antenna of this kind with a so-called "spiral" type antenna, as described for example in DE-B-1 056 673. However, without some kind of adaptation this antenna can receive only in the axial mode. The invention therefore proposes, in particular to receive digital audio broadcast radio signals, combining a skirt antenna (of the type disclosed by the aforementioned U.S. Pat. No. 2,531,476), which is adapted to receive signals transmitted by terrestrial broadcast stations, with a helical antenna disposed vertically above the skirt antenna and coaxially with it, the surface closing the upper part of the skirt antenna tube constituting a reflective plane to provide for the helical antenna a hybrid radiation mode which is partially axial and partially radial by lowering the receive lobe of the usual radiation pattern towards an elevation angle suitable for receiving signals transmitted via satellite, and coupling means for combining the signals received by each of the two antennas and feeding them to a common coaxial line.

Pre-amplifier means are advantageously provided between the output of the helical antenna and the input of the coupling means and narrowband phase-inverting multipole filter means are advantageously provided between the output of the pre-amplifier means and the input of the coupling means.

The height of the skirt-helix assembly above said artificial ground is preferably adjustable.

The coaxial line is preferably in the form of a rigid or semi-rigid conductor, the combination of the skirt, the spiral, the coupling means and the coaxial line being a self-supporting assembly held above said artificial ground by said conductor and surrounded by a radome joined at the bottom to said artificial ground via sealing means.

One embodiment of the invention will now be described with reference to the appended drawings.

DETAILED DESCRIPTION OF THE INVENTION

Figure 1:
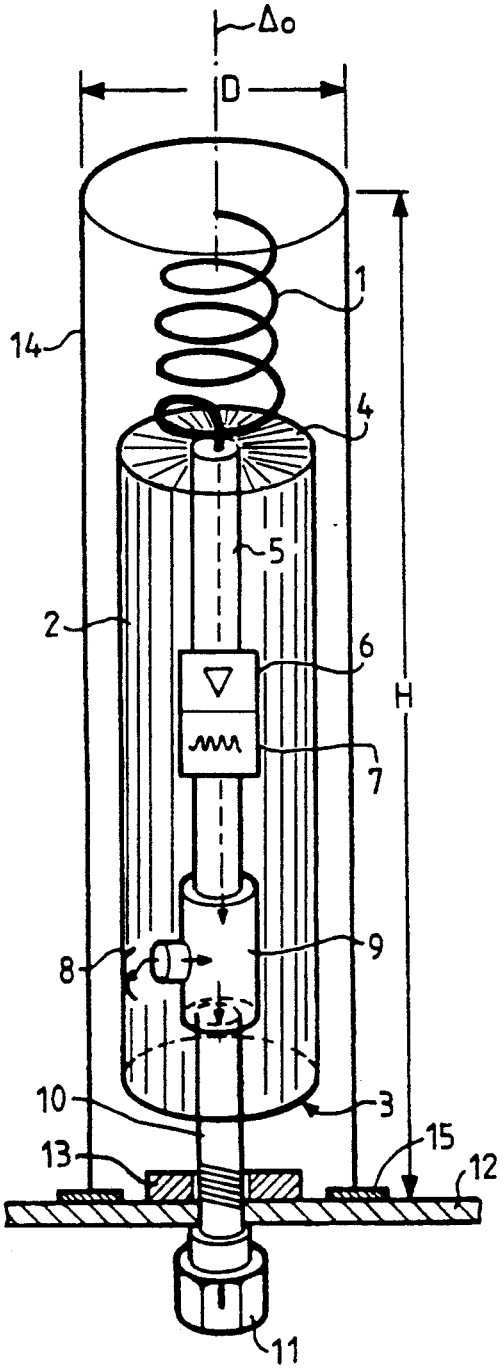
FIG. 1 is a diagrammatic perspective view of an antenna in accordance with the invention.

Referring to FIG. 1, a helical antenna 1 comprises a spiral conductor wire and is combined with a skirt antenna 2 comprising a conductive cylindrical tube open at the lower end 3 and closed at the top 4 by a flat disk short-circuiting the cylindrical tube at this location.

The skirt-helix combination is supported by a self-supporting semi-rigid coaxial line 5 into which are inserted an amplifier 6 and a phase-shifter filter 7. The amplifier 6 and the filter 7 process the signal picked up by the helical antenna 1. The signal received by the skirt antenna 2 is sampled at a feed point 8 and combined by a coupler 9 with the amplified and filtered signal received by the helical antenna. The coupler output is connected to a coaxial line section 10 terminating at a connector 11 adapted to be connected to the receiver. The assembly is mounted on the roof 12 of a vehicle, for example, with a nut-and-bolt system 13 for adjusting the height of the skirt above the roof.

The antenna assembly may advantageously be mounted inside a radome 14, made from polyester, for example, resting on the roof 12 of the vehicle through a seal 15.

The antenna assembly therefore forms a cylinder rising above the vehicle with a height H in the order of 10 cm and a diameter D in the order of 3 cm (these dimensions assume that the received signal frequency is around 1.5 GHz).

The various component parts of the antenna will now be described.

The helical antenna 1 adapted to receive signals transmitted via satellite will be described first.

Figure 2:
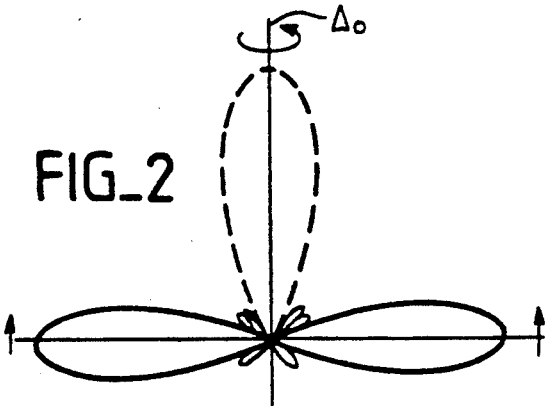
FIGS. 2 and 3 show how the radiation pattern of the helical antenna is modified to enable signals transmitted by satellite to be received.

An antenna of this kind is well known in itself, comprising a spiral wound metal conductor excited at the base. However, the antenna can radiate in two essentially different modes depending on the pitch and the diameter of the helix: in the first of these modes, covering most known applications of helical antennas, the antenna radiates essentially with the radiation pattern shown in dashed line in FIG. 2, that is to say with an axial lobe ($_0$ being the axis of the helix) and circular polarization; on the other hand, and especially for extremely short antennas (in other words, when the pitch is very small in comparison with the diameter, a relatively rare circumstance in practice) the radiation pattern is essentially radial with vertical rectilinear polarization, as shown in full line in FIG. 2 (in all cases the radiation pattern is omnidirectional in azimuth).

The lower end of the conductor, that is to say the part of the conductor joining the spiral to the end of the coaxial line, is configured so as to form with the metal disk 4 of the skirt 2 an impedance matching device which avoids the use of any additional component for matching the impedance.

One of the novel features of the present invention is that it causes the helical antenna to radiate not in one or other of these two typical modes but rather in a hybrid intermediate mode obtained by deforming the axial radiation pattern in such as a way as to depress it on the axis and so lower the main receive lobe towards an elevation angle suitable for receiving a signal transmitted via satellite.

Figure 3:
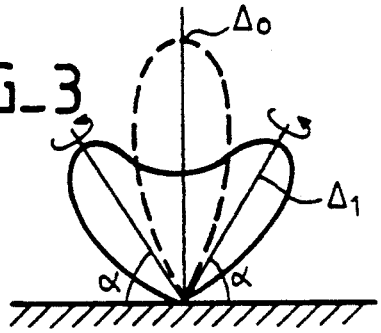

The deformed radiation pattern for the hybrid mode is shown in FIG. 3 in full line (the diagram in dashed line represents the pure axial mode); note that in this way it is possible to orient the axis $_1$ of the main lobe towards an elevation angle $\alpha$ representing the general direction of the satellites which transmit the signal to be received, and this whilst retaining circular polarization typical of satellite transmission (this deformation of the radiation pattern leaves the latter omnidirectional in azimuth, of course). The depression in the radiation pattern on the vertical axis $_0$, a direction in which there are no transmissions to be received, increases the gain in the satellite pointing direction $_1$ by an amount in the order of 2 dB compared with isotropic reception.

By virtue of one feature of the invention, this deformation of the diagram to cause the antenna to radiate in the hybrid mode is obtained by the presence of the flat disk 4 short-circuiting the skirt 2 at the upper end and which, in a configuration in accordance with the invention, constitutes for the helix a reflective plane enabling modification of the radiation pattern in the required sense. Note, incidently, that the metal roof 12 disposed relatively far behind the helix had virtually no effect on its radiation pattern.

The parameters which contribute to the deformation of the radiation pattern and which render the radiation mode hybrid are essentially: the size of the reflector disk 4, the position of the latter relative to the helix (the distance between them) and the dimensions (diameter and pitch) of the helix turns. Note also that the presence of the reflector disk 4 advantageously enables the gain of the helix to be slightly increased as the result of "retransmission".

The skirt antenna 2 for receiving signals transmitted by terrestrial broadcasting stations will now be described.

The operation of an antenna of this kind, as such, is known: it is a near quarter-wavelength section (in size and in radiation terms, a frequency of 1.5 GHz, typical of DAB signals, representing a quarter-wavelength of 5 cm) fed from the interior by an output of the coupler 9 at a feed point 8 representing an impedance near that of the coupler and of the complete antenna (typically an impedance of 50 Ω). The feed point is determined so that the real part of the admittance is equal to 50 Ω, the reactive admittance being eliminated by the skirt section below the feed point, which behaves as a correction stub.

The skirt is supported by the semi-rigid coaxial line 5 which passes through the upper part 4 to feed the helical antenna. The diameter of the skirt, the diameter of the coaxial line 5 and the total height of the skirt are optimized to meet various mechanical and electrical constraints (the diameter of the skirt affecting the bandwidth in particular).

The influence of the helical antenna on the skirt antenna is small (although the converse is not true, as remarked upon above), as the helix and the skirt are not interconnected electrically (the coupler 9 is an insulative coupler). A slight terminal capacitive effect is possible, however, requiring that the skirt be adjusted with the helix present.

Figure 4:
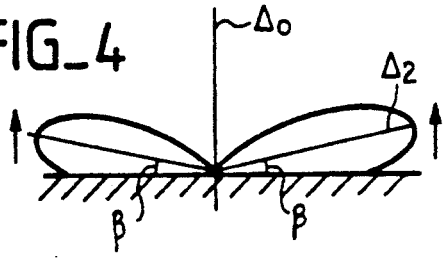
FIG. 4 shows the radiation pattern of the skirt antenna for receiving signals transmitted by terrestrial broadcasting stations.

FIG. 4 shows the radiation pattern of the skirt which has a gain in the order of 4 dB in a direction $_2$ as compared with isotropic radiation for a low elevation angle $\beta$ typically in the order of 5° to 20°. The skirt antenna radiates with vertical rectilinear polarization, unlike the helix which radiates with circular polarization.

To obtain this radiation pattern the skirt antenna has to be placed above a metal surface such as the metal roof of a vehicle. If this is not possible (other configuration or non-metal roof), a metal disk must be provided under the skirt with a diameter in the order of 20 cm or some other form of artificial ground providing a similar function.

Figure 5:
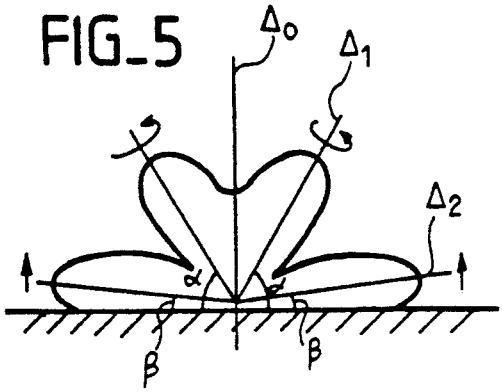
FIG. 5 shows the overall radiation pattern of the antenna.

FIG. 5 shows the overall radiation pattern of an antenna in accordance with the invention resulting from the combination of the FIG. 3 (helix) and FIG. 4 (skirt) radiation patterns: note that the resultant diagram has two predominant directions, a direction $_1$ for receiving signals transmitted via satellite with an elevation angle $\alpha$ in the order of 60° and circular polarization and a direction $_2$ for receiving signals transmitted by terrestrial broadcasting stations with a very low elevation angle $\beta$ (5° to 20°) and vertical rectilinear polarization. The radiation pattern is omnidirectional in azimuth, of course.

The electrical circuit of the antenna will now be described.

The signals received by the skirt 2 and by the helix 1 are combined in a low-loss coupler 9 which provides adequate isolation between its two input channels. It is matched to a value of typically 50 ohms. The coupler 9 may be a commercially available miniature 3 dB coupler or "combiner" disposed inside the skirt 2, this configuration representing a significant saving in space and being neutral from the radio point of view (as with the amplifier 6 and the filter 7).

A miniature amplifier (not shown) may advantageously be provided inside the skirt at the output of the coupler 9 and supplied with power via the coaxial line to raise the high-frequency signal level by about 10 to 20 dB and so significantly improve the signal/noise ratio by virtue of in-antenna amplification on the input side of the cable connected to the receiver (producing a so-called "active" antenna).

To increase the level of the satellite signal and to compensate for the insertion loss of the filter 7, an amplifier 6 is preferably provided in the helical antenna circuit on the input side of the coupler; the isolation provided by the coupler 9 makes it possible to add an amplifier stage to one of the coupler inputs, avoiding any feedback to the amplifier 6 which could produce parasitic modes.

The filter 7 imposes a phase-shift of $\pi$ on a small frequency variation (typically a range of 3 MHz about a center frequency of 1.5 GHz) in order to implement the COFDM (Coded Orthogonal Frequency Division Multiplex) technique, a modulation and spectrum organization method developed as an alternative to spread spectrum techniques: in the absence of specific processing, the bandwidth resource for broadcasting a digital audio program would be prohibitive. The COFDM technique is based on the principle of dividing the original frequency band into a large number of narrowband sub-channels into which transmission does not introduce any distortion. The component signals are orthogonal to each other which enables spectral interleaving of sub-channels achieving great spectral efficiency by spreading the signal energy uniformly in the frequency band.

In the case of simultaneous reception of signals by the two antennas (the helix and the skirt), the time-delays introduced by the different propagation paths (from the terrestrial station(s) and via the satellite) are such that, overall, the transmission channel has the features of a Rayleigh channel, in other words its response to a pulse comprises a series of pseudo-pulses whose amplitude follows a Rayleigh law; in the absence of specific measures, this would create numerous digital data transmission errors because of signal attenuation and distortion. The COFDM technique alleviates this drawback.

To conserve the compact overall dimensions of the system, the filter 7 may be a multipole filter (typically a filter with 8 to 10 poles) or a surface acoustic wave filter rather than a long phase-shifter line, producing similar effects.

There is claimed:

1. A composite antenna comprising, in combination:

a skirt-helix assembly having first and second radiating elements operating independently to separately receive respective first and second signals of like frequency;

said first radiating element comprising a quarter-wavelength skirt antenna adapted to be disposed over an artificial ground and comprising a vertically disposed cylindrical tube having a closure surface closing an upper end of said tube, and a feed point means on a wall of said tube for sampling said first signal received by said skirt antenna, said skirt antenna having a radiation pattern which is essentially omnidirectional with a low elevation angle suitable for receiving signals from terrestrially situated transmitting antennas;

said second radiating element comprising a helical antenna disposed vertically and coaxially above said skirt antenna and insulated therefrom with said closure surface constituting a reflective plane means for modifying a typical radiation pattern of said helical antenna, by lowering a receive lobe of said radiation pattern to an elevation angle suitable for receiving signals from a satellite, so as to provide a hybrid radiation pattern which is partially axial and partially radial, said helical antenna also having a feed line means for sampling said second signal received by said helical antenna, said feed line means having an outer conductor being in electrical contact with said closure surface of said skirt antenna and an inner conductor being insulated from said outer conductor, passing through said closure surface to an inside of said skirt antenna, and electrically attached to said helical antenna; and coupling means for receiving said first and second signals of like frequency from said feed point means and said feed line means, respectively, and for combining and feeding said like frequency signals from an output of said coupling means on a common line.

2. A composite antenna according to claim 1, and further comprising:

preamplifier means, disposed between an output of said helical antenna and an input of said coupling means, for amplifying a signal being fed to said coupling means from said helical antenna.

3. A composite antenna according to claim 2, and further comprising:

narrowband phase-shifting multipole filter means, disposed between an output of said preamplifier means and the input of said coupling means, for shifting a phase of said output from said preamplifier means.

4. A composite antenna according to claim 1, and further comprising:

means for adjusting a height above said artificial ground of said skirt-helix assembly of said composite antenna.

5. A composite antenna according to claim 1, and further comprising:

a coaxial cable means for providing electrical attachment of said feed line means to said coupling means and said common line from said output of said coupling means, said coupling means and said coaxial cable means being structurally disposed and sufficiently rigid so as to support said skirt-helix assembly above said artificial ground.

6. A composite antenna according to claim 5, and further comprising:

a radome, surrounding said skirt-helix assembly and having a bottom joined to said artificial ground via a seal, providing a dielectric housing for said skirt and helical antennas.

* * * * *